US007278880B1

(12) United States Patent
Wu

(10) Patent No.: US 7,278,880 B1
(45) Date of Patent: Oct. 9, 2007

(54) JUMPER BOARD

(75) Inventor: Peter Wu, Taipei (TW)

(73) Assignee: Hsing Chau Industrial Co., Ltd., Taipei, Taipei (TW)

( * ) Notice: Subject to any disclaimer, the term of this patent is extended or adjusted under 35 U.S.C. 154(b) by 36 days.

(21) Appl. No.: 11/393,814

(22) Filed: Mar. 31, 2006

(51) Int. Cl.
*H01R 13/66* (2006.01)

(52) U.S. Cl. ..... 439/540.1

(58) Field of Classification Search ..... 439/540.1, 439/676

See application file for complete search history.

(56) References Cited

U.S. PATENT DOCUMENTS 6,761,585 B2 * 7/2004 Clark et al. ..... 439/540.1

6,974,348 B2 * 12/2005 Bentley ..... 439/540.1

* cited by examiner

*Primary Examiner*—Tho D. Ta
(74) *Attorney, Agent, or Firm*—Troxell Law Office, PLLC

(57) ABSTRACT

Jumper board is disclosed to include a bracket, face panels respectively mounted on the bracket, each face panel having a springy hook hooked on a locating flange of the bracket, circuit boards respectively mounted in the bracket corresponding to the face panels, back plates respectively fastened to the face panel and covered on the circuit boards at the back, and levers respectively pivotally mounted in the face panels and respectively rotatable to force the springy hooks of the associating face panels from the bracket for allowing dismounting of the associating face panels from the bracket.

2 Claims, 11 Drawing Sheets

JUMPER BOARD

BACKGROUND AND SUMMARY OF THE INVENTION

The present invention relates to a jumper board and more particularly, to such a jumper board that allows dismounting of the face panels from the bracket quickly without tools.

A conventional jumper board is known comprised of a bracket, a plurality of face panels respectively mounted on the bracket, a plurality of circuit boards respectively mounted in the bracket corresponding to the face panels, and a plurality of back plates respectively fastened to the face panel and covered on the circuit boards at the back. The face panels are respectively fastened to the bracket with screws and nuts. It takes much labor and time to mount/dismount the face panels. There is known another design of jumper board in which the face panels are detachably fastened to the bracket with a hook joint. This design allows dismounting of the face panels from the bracket without tools. However, it is inconvenient to grasp each face panel with the fingers and to apply a biasing force to each face panel when wishing to dismount each face panel from the bracket.

The present invention has been accomplished under the circumstances in view. It is the main object of the present invention to provide a jumper board, which allows dismounting of the face panels from the bracket quickly without tools. To achieve this and other objects of the present invention, the jumper board comprises a bracket, a plurality of face panels respectively mounted on the bracket, each face panel having a springy hook hooked on a locating flange of the bracket, a plurality of circuit boards respectively mounted in the bracket corresponding to the face panels, a plurality of back plates respectively fastened to the face panel and covered on the circuit boards at the back, and a plurality of levers respectively pivotally mounted in the face panels and respectively rotatable to force the springy hooks of the associating ace panels from the bracket for allowing dismounting of the associating face panels from the bracket.

DETAILED DESCRIPTION OF THE INVENTION

Figure 1:
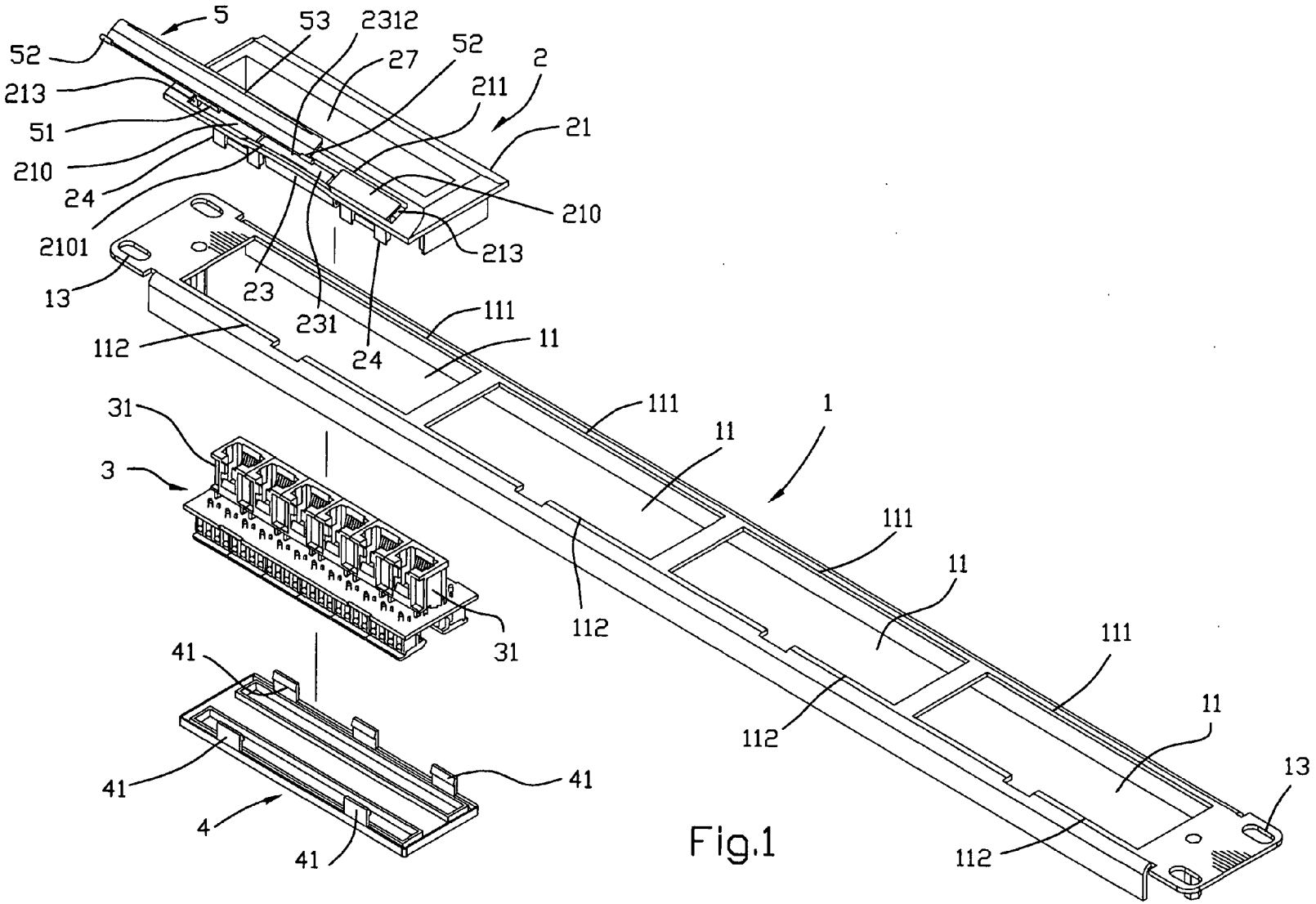
FIG. 1 is an exploded view of a jumper board according to the present invention.
Figure 2:
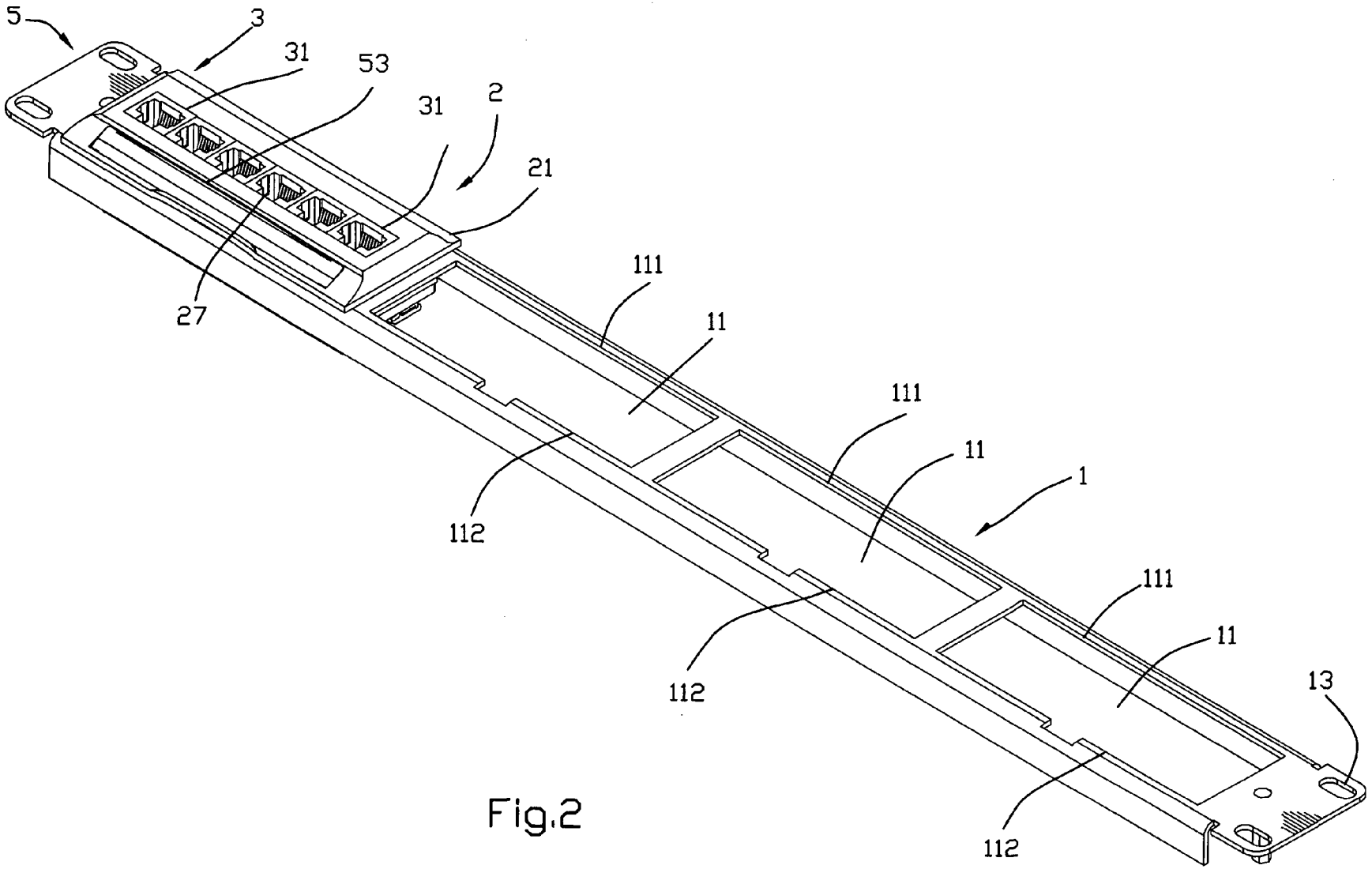
FIG. 2 is an elevational assembly view of the jumper board according to the present invention.
Figure 3:
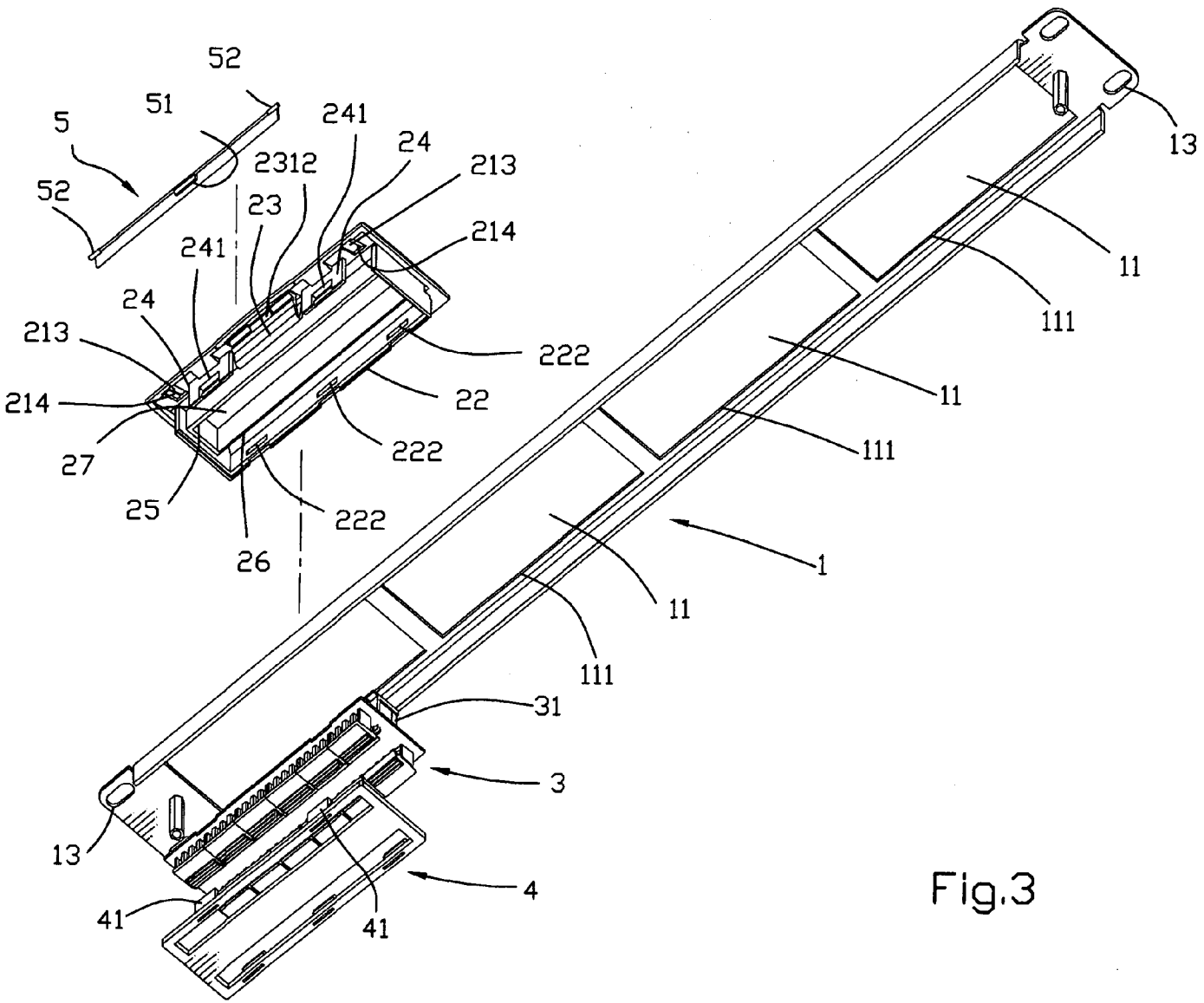
FIG. 3 corresponds to FIG. 1 when viewed obliquely from the bottom side.
Figure 4:
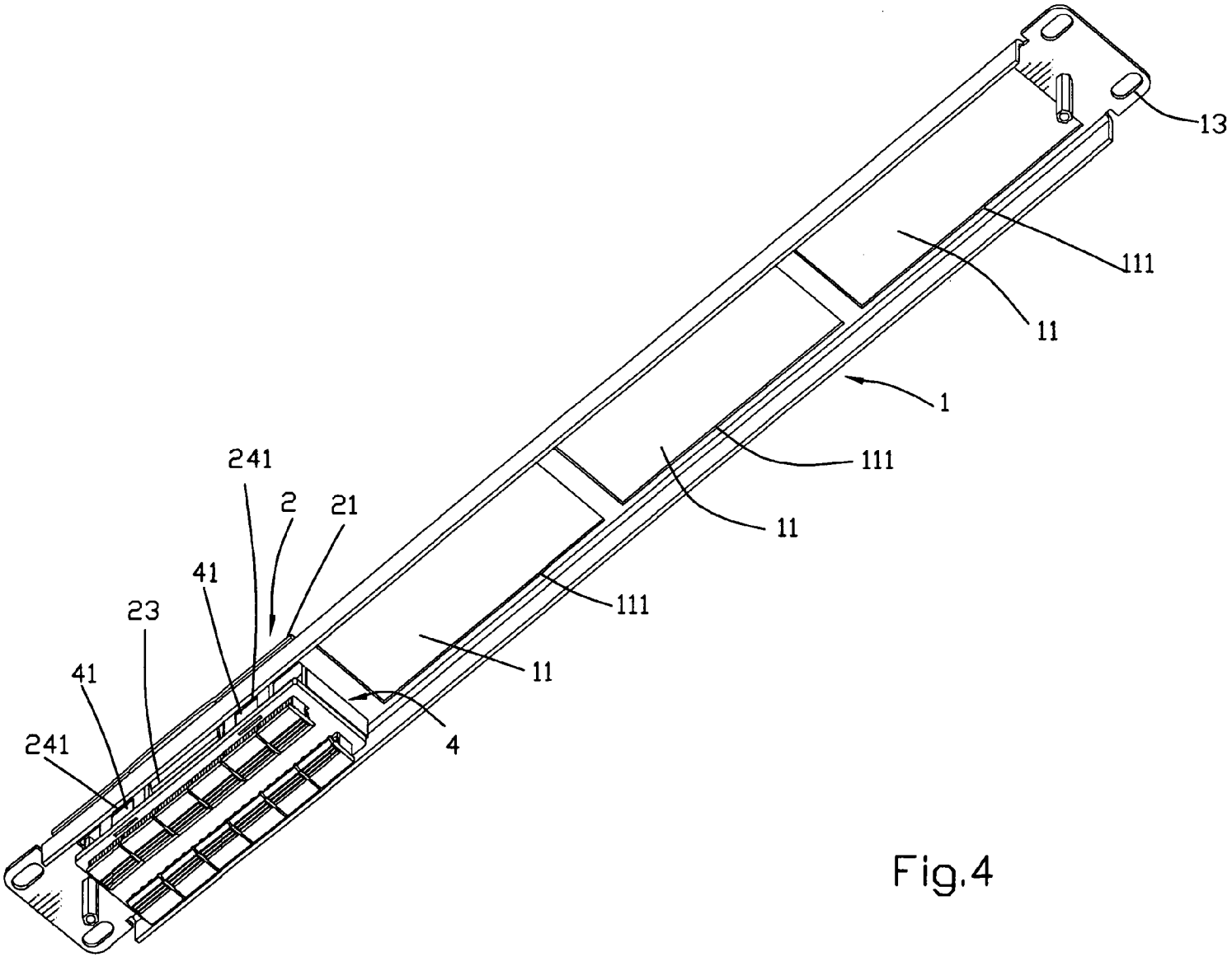
FIG. 4 corresponds to FIG. 3 when viewed obliquely from the bottom side.
Figure 5:
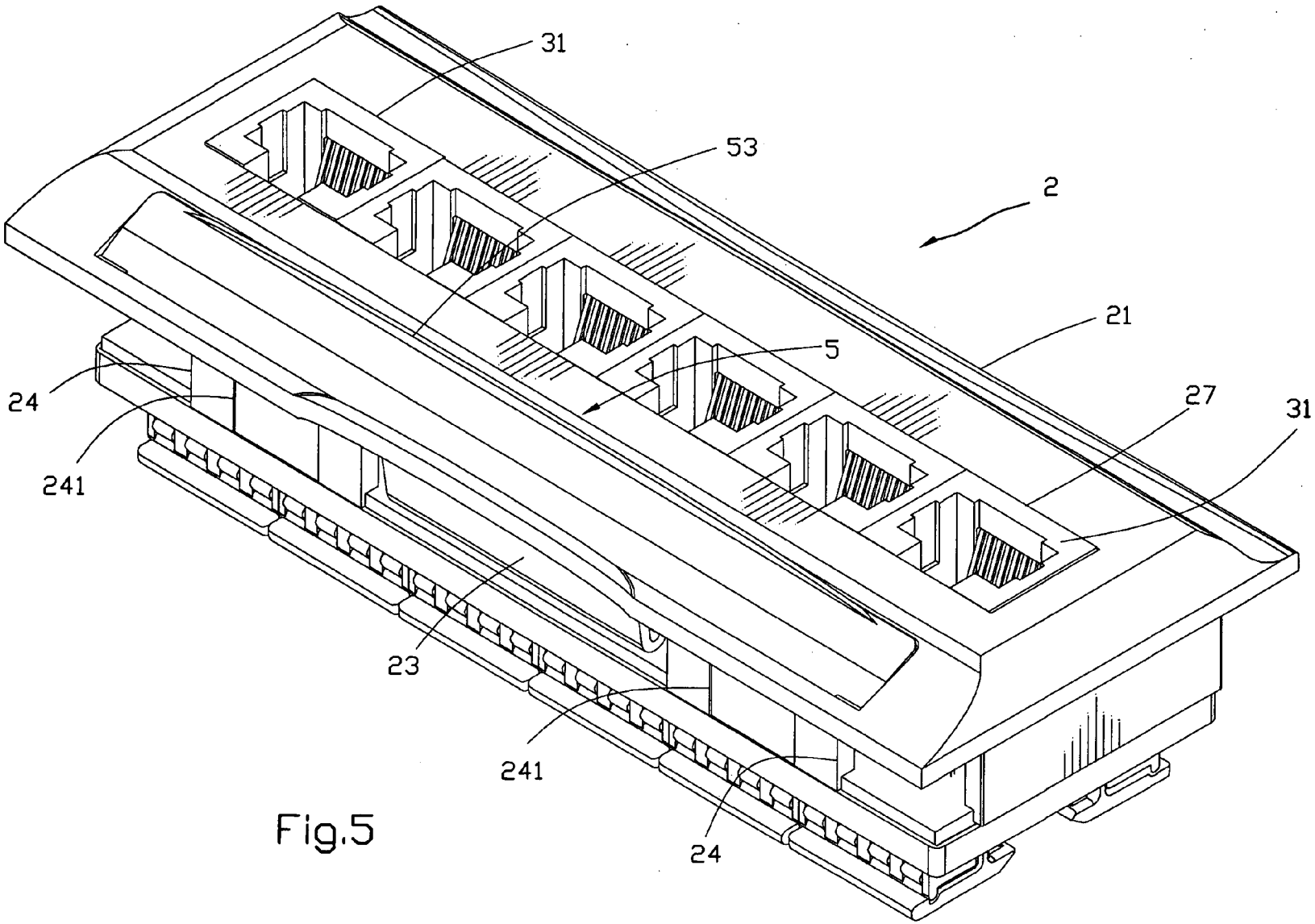
FIG. 5 is an enlarged view of a part of the jumper board according to the present invention.
Figure 6:
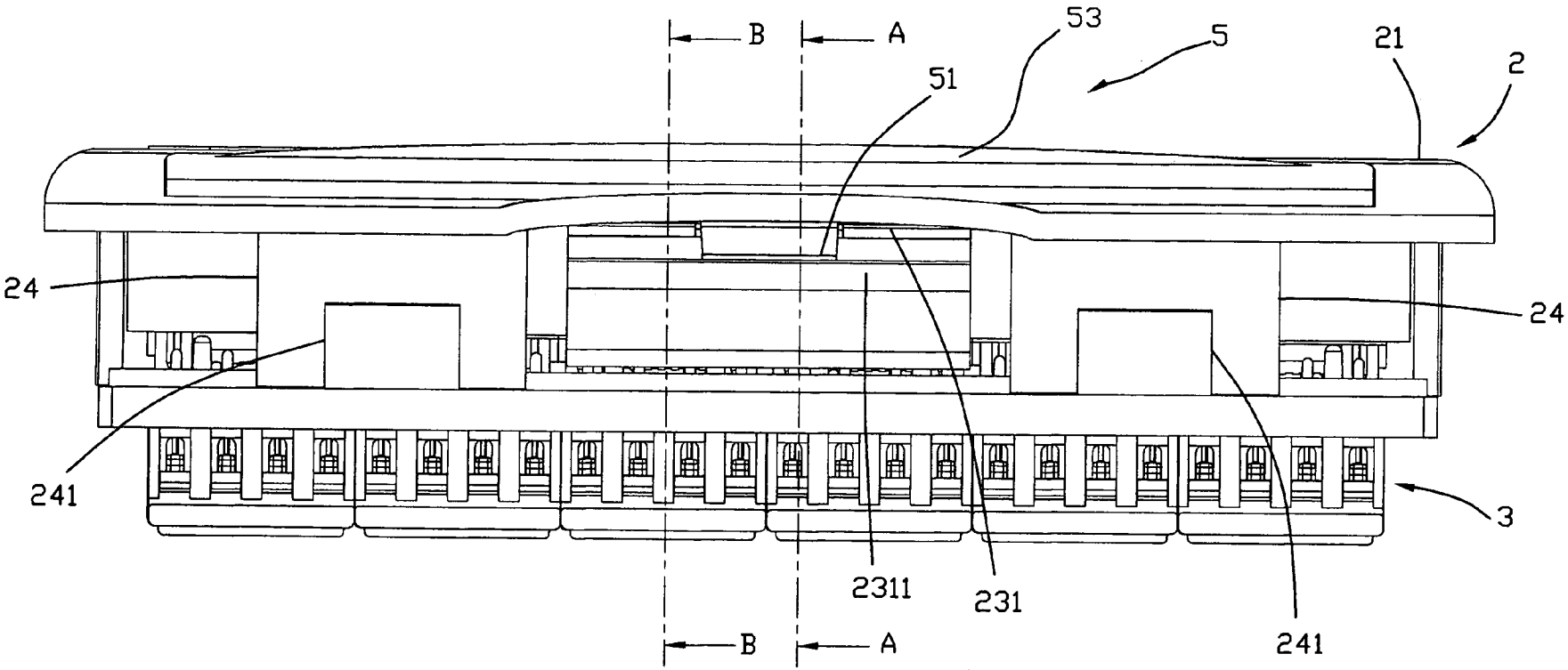
FIG. 6 is a side view of FIG. 5.
Figure 7:
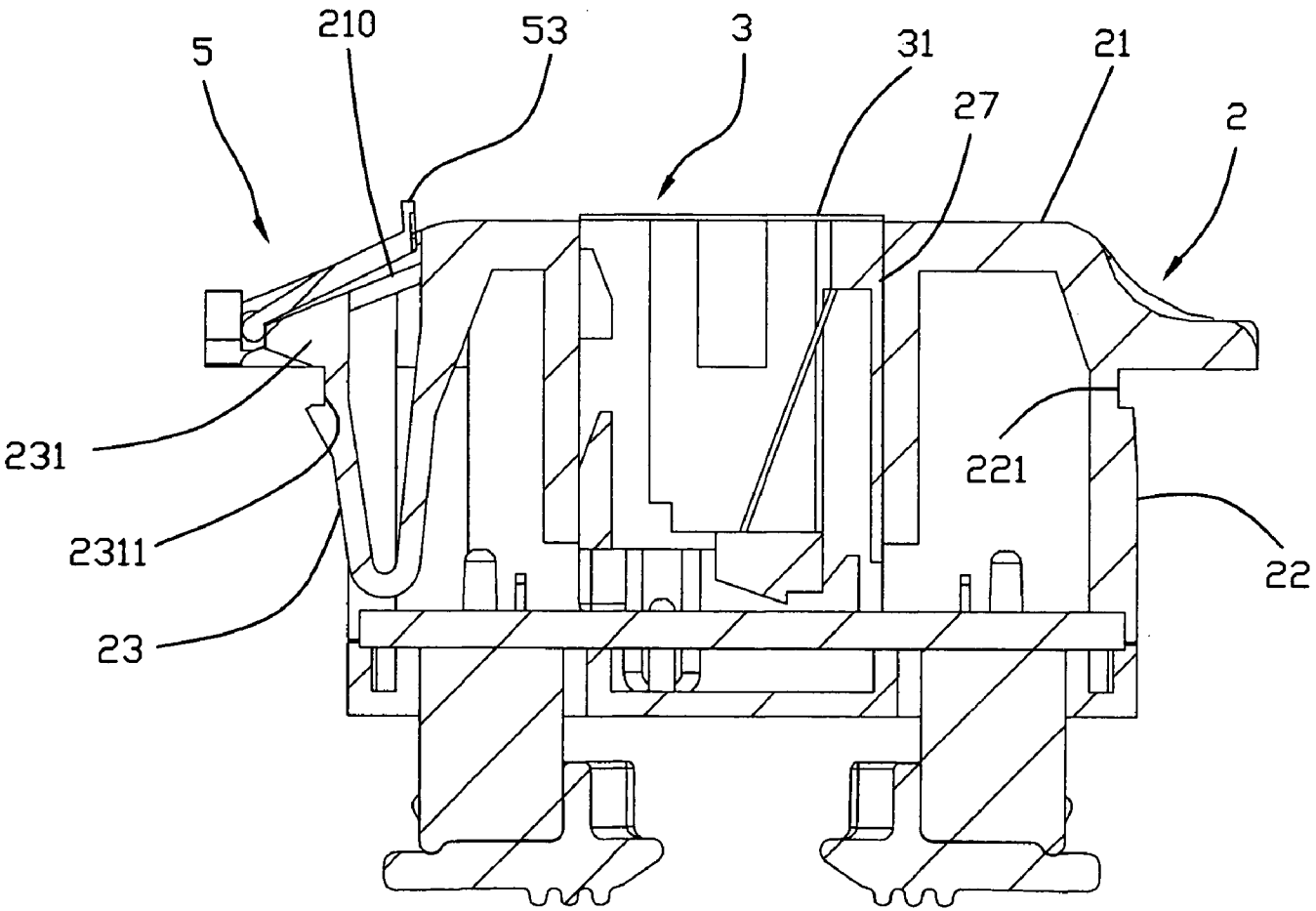
FIG. 7 is a sectional view taken along line B-B of FIG. 6.
Figure 8:
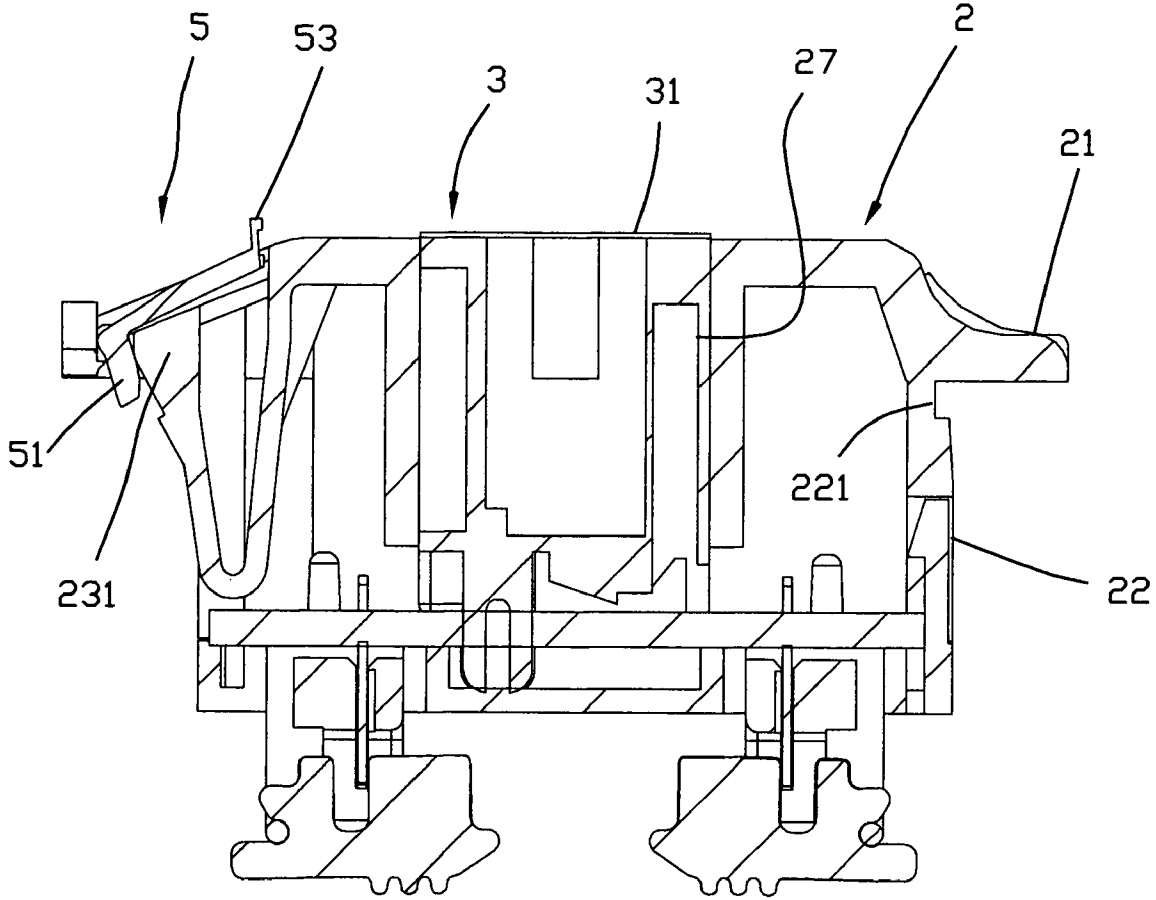
FIG. 8 is a sectional view taken along line A-A of FIG. 6.
Figure 9:
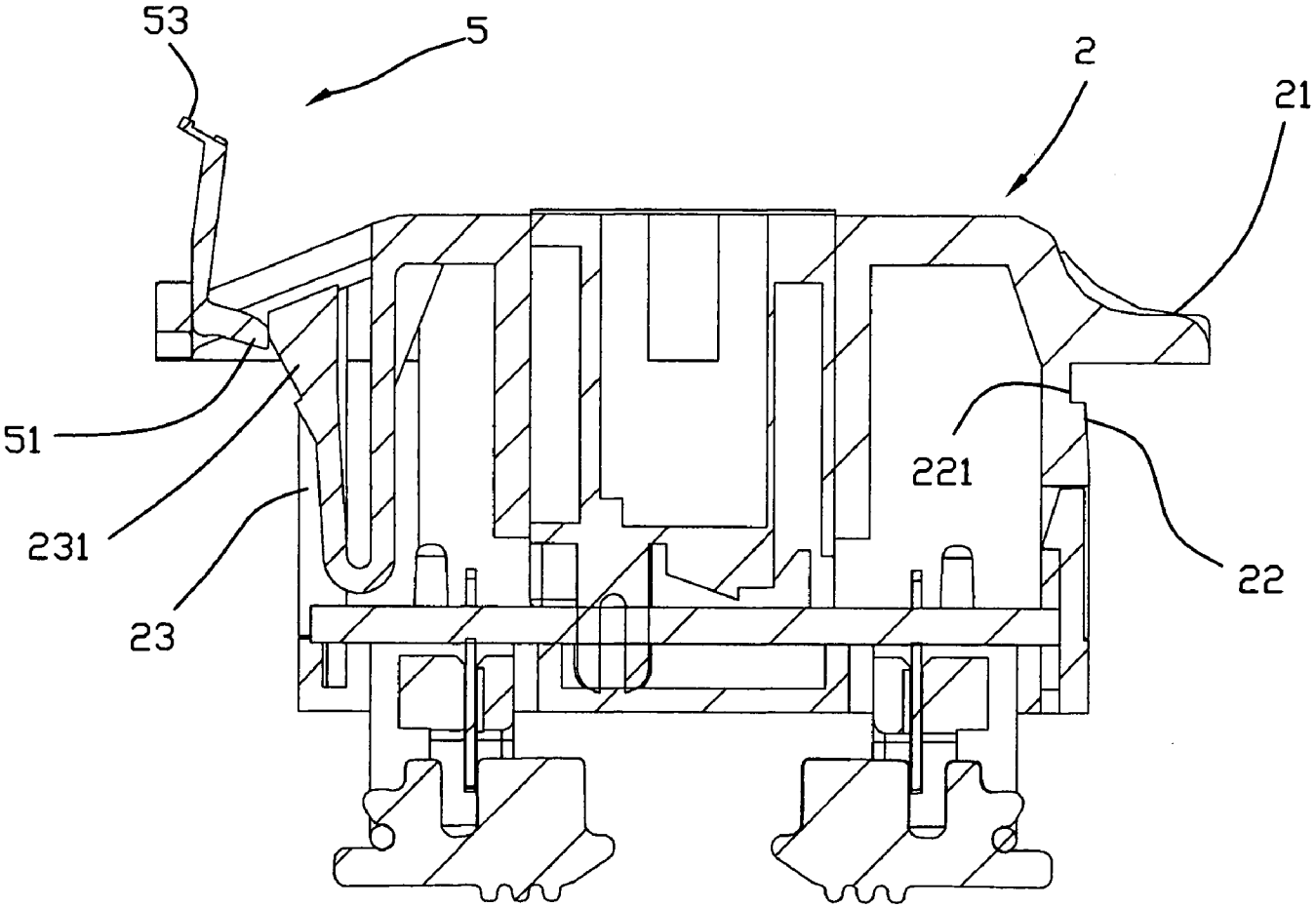
FIG. 9 corresponds to FIG. 8, showing the lever biased.
Figure 10:
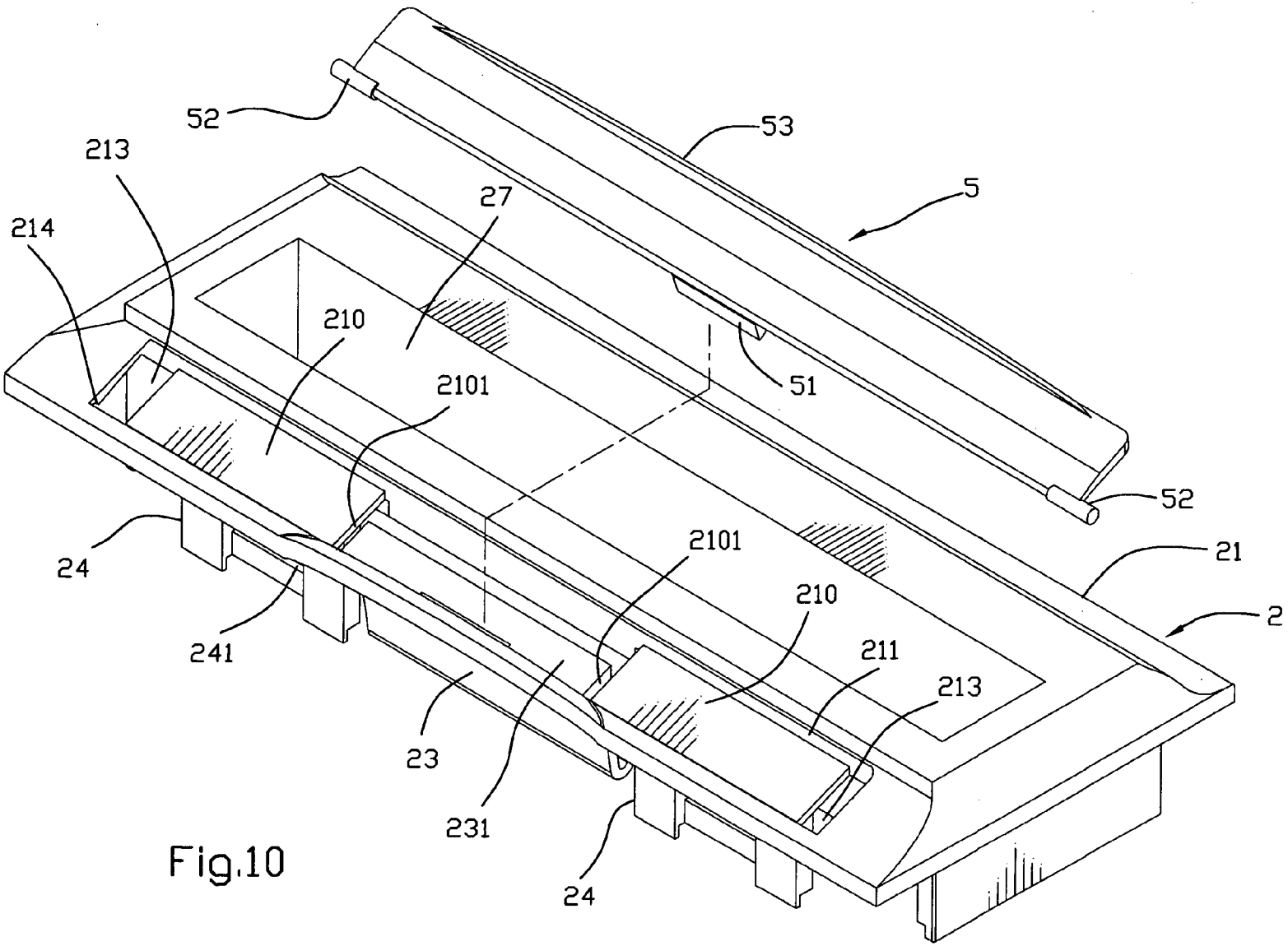
FIG. 10 is an exploded view in an enlarged scale of a part of the present invention, showing the relationship between the lever and the associating face panel.
Figure 11:
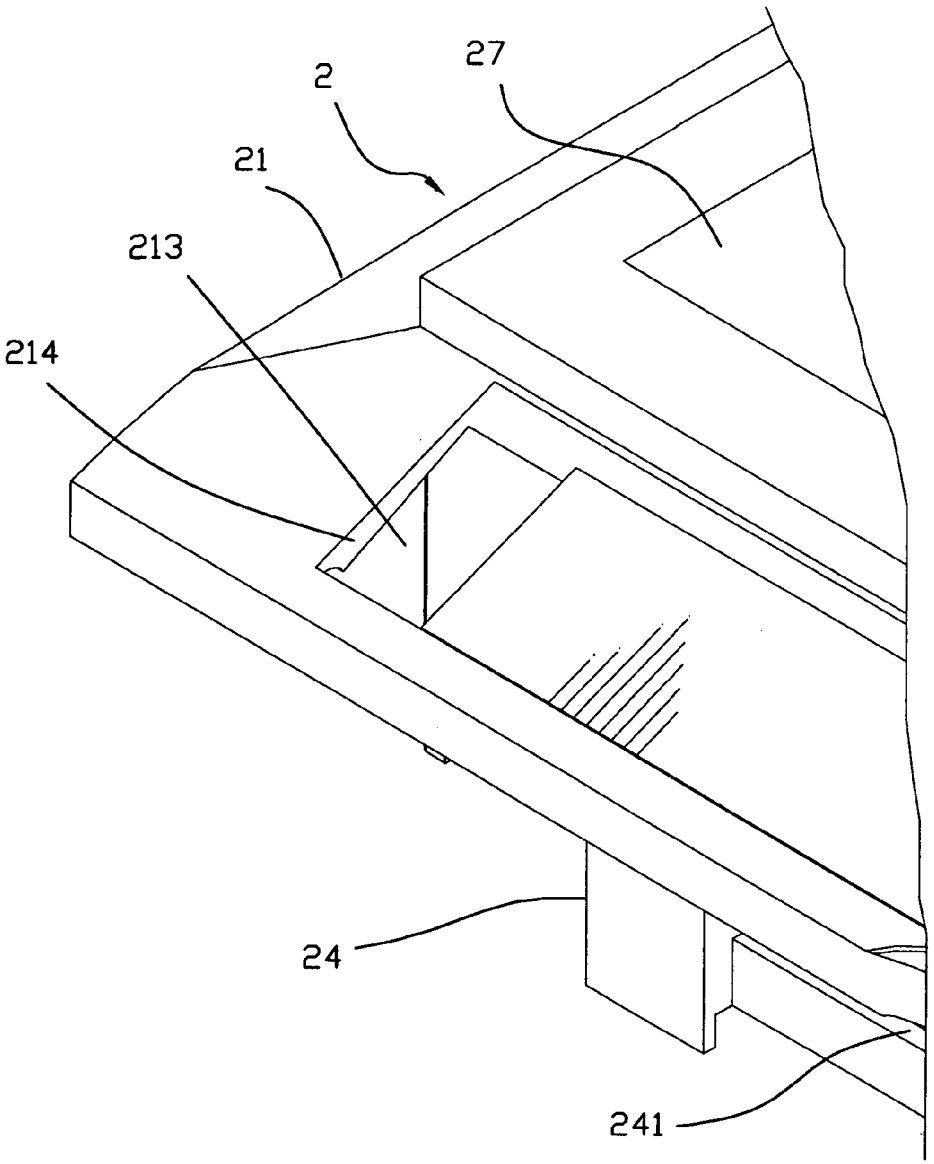
FIG. 11 is an enlarged view of a part of one face panel for the jumper board according to the present invention.

Referring to FIGS. 1~11, a jumper board in accordance with the present invention is shown comprising a bracket 1, a plurality of face panels 2, a plurality of circuit boards 3, and a plurality of back plates 4.

The bracket 1 has a plurality of locating slots 11 that hold the face panels 2 respectively, and a plurality of mounting holes 13 disposed at the two distal ends for the mounting of respective fastening members (not shown) to affix the bracket 1 to an electronic apparatus. Each locating slot 11 has two mounting flanges 111 and 112 arranged in parallel at two opposite lateral sides.

Each face panel 2 has a base 21, a locating wall 22 and a springy hook 23 bilaterally downwardly extending from the bottom side of the base 21, the springy hook 23 having a hooked portion 231 and a retaining notch 2311 at the hooked portion 231 (see FIG. 3), a locating groove 221 formed on the outer side of the locating wall 22 adjacent to the base 21 (see FIG. 7), two extension walls 24 downwardly extending from the bottom side of the base 21 and suspending at two sides relative to the springy hook 23, a plurality of retaining notches 222 and 241 respectively formed on the locating wall 22 and the extension walls 24 for securing one back plate 4, two parallel inside walls 25 and 26 respectively downwardly extending from the bottom side of the base 21 (see FIG. 3), and an elongated slot 27 defined between the two parallel inside walls 25 and 26. By means of forcing the retaining notch 2311 of the hooked portion 231 of the springy hook 23 and the locating groove 221 of the locating wall 22 into engagement with the two mounting flanges 111 and 112 of one locating slot 11 of the bracket 1, the face panel 2 is fastened to the associating locating slot 11 of the bracket 1.

The circuit boards 3 are respectively mounted in the locating slots 11 of the bracket 1 corresponding to the face panels 2, each having a plurality of module jacks 31 inserted into the elongated slot 27 in the associating face panel 2.

The back plates 4 are respectively fastened to the face panels 2 and covered on the circuit boards 3 at the back side, each having a plurality of retaining lugs 41 respectively engaged into the retaining notches 222 and 241 on the locating wall 22 and extension walls 24 of the associating face panel 2.

The main features of the present invention are outlined hereinafter.

The base 21 of each face panel 2 has a longitudinal groove 211 (see FIGS. 1 and 10), two stop blocks 210 provided inside the longitudinal groove 211 at two sides of the hooked portion 231 of the springy hook 23 and respectively spaced from the hooked portion 231 at a gap 2101, two pivot holes 214 respectively disposed on the two distal ends of the longitudinal groove 211, and two through holes 213 respectively disposed between the pivot holes 214 and the stop blocks 210. A lever 5 is respectively set in the longitudinal groove 211 of each face panel 2 and supported on the stop blocks 210. The lever 5 has two round rods 52 respectively disposed at the two distal ends and respectively pivoted to the pivot holes 214 of the associating face panel 2, and a butt 51 disposed on the middle and engaged into an outer groove 2312 at the outer side of the hooked portion 231 of the springy hook 23 of the associating face panel 2. When biasing the lever 5, the butt 51 is forced to move the springy hook 23, causing the springy hook 23 to disengage the retaining notch 2311 of the hooked portion 231 from the mounting flange 112 of corresponding locating slot 11 of the bracket 1 (see FIG. 9), allowing dismounting of the associating face panel 2 from the bracket 1 for repair, maintenance, or examination. Therefore, the face panel 2 can easily and quickly detached from the bracket 1 without tools.

The lever 5 further has a finger strip 53. The user can hold the finger strip 53 with the fingers when biasing the lever 5.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A jumper board comprising:

a bracket, said bracket having a plurality of locating slots, and a plurality of mounting holes disposed at two distal ends thereof for the mounting, said locating slot each having two mounting flanges arranged in parallel at two opposite lateral sides;

a plurality of face panels respectively mounted in the locating slots of said bracket, said face panels each having a base, a locating wall and a springy hook bilaterally downwardly extending from said base, said springy hook having a hooked portion and a retaining notch at said hooked portion, a locating groove formed on an outer side of said locating wall adjacent to said base, two extension walls downwardly extending from said base and suspending at two sides relative to said springy hook, a plurality of retaining notches respectively formed on said locating wall and said extension walls, two parallel inside walls respectively downwardly extending from said base, and an elongated slot defined between said two parallel inside walls, the retaining notch of the hooked portion of the springy hook and the locating groove of the locating wall of each of said face panels being respectively engaged with the two mounting flanges of each locating slot of said bracket;

a plurality of circuit boards respectively mounted in the locating slots of said bracket corresponding to said face panels, said circuit boards each having a plurality of module jacks respectively inserted into the elongated slots in said face panels;

a plurality of back plates respectively fastened to said face panels and covered on said circuit boards at a back side, said back plates each having a plurality of retaining lugs respectively engaged into the retaining notches on the locating wall and extension walls of each of said face panels;

wherein:

the base of each of said face panels has a longitudinal groove, two stop blocks provided inside said longitudinal groove at two sides of the hooked portion of the springy hook of the respective face panel and respectively spaced from the hooked portion at a gap, two pivot holes respectively disposed on two distal ends of said longitudinal groove, and two through holes respectively disposed between said pivot holes said stop blocks;

a lever set in the longitudinal groove of each face panel and supported on the stop blocks of the respective face panel, said lever having two round rods respectively disposed at two distal ends thereof and respectively pivoted to the pivot holes of the associating face panel, and a butt extending from a middle part thereof and engaged into an outer groove at an outer side of the hooked portion of the springy hook of the associating face panel such that biasing said lever causes said butt to move the associating springy hook and therefore the associating springy hook is forced to disengage the retaining notch of the hooked portion thereof from the mounting flange of corresponding locating slot of said bracket for allowing dismounting of the associating face panel from said bracket.

2. The jumper board as claimed in claim 1, wherein said lever has a finger strip extending from a middle part thereof for grasping by the user.

* * * * *